United States Patent [19]

Witczak

[11] Patent Number: 5,033,376

[45] Date of Patent: Jul. 23, 1991

[54] SEGMENTED MOISTURE FOUNTAIN ROLLER ASSEMBLY FOR PRINTING OR DUPLICATING MACHINES

[75] Inventor: Stanley Witczak, Chicago, Ill.

[73] Assignee: AM International, Inc., Chicago, Ill.

[21] Appl. No.: 458,920

[22] Filed: Dec. 29, 1989

[51] Int. Cl.[5] ..... B41L 23/02

[52] U.S. Cl. ..... 101/148; 101/348

[58] Field of Search ..... 101/147, 148, 348, 350, 101/207, 208, 210; 29/121.5, 124, 125

[56] References Cited

U.S. PATENT DOCUMENTS

| | | | |
|---|---|---|---|
| 580,326 | 4/1897 | McCallum | 101/208 |
| 4,682,543 | 7/1987 | Witczak et al. | 101/350 |

FOREIGN PATENT DOCUMENTS

| | | | |
|---|---|---|---|
| 0145453 | 8/1983 | Japan | 101/148 |
| 54695 | 3/1911 | Switzerland | 101/348 |

*Primary Examiner*—Edgar S. Burr
*Assistant Examiner*—Ren Yan
*Attorney, Agent, or Firm*—Wood, Phillips, Mason, Recktenwald & VanSanten

[57] ABSTRACT

A moisture distribution roller assembly for use in a moisture feeding system of a printing, duplicating or like machine includes a shaft with a plurality of roller sections slidably mounted thereon. The roller sections are selectively positionable on the shaft at varying axial positions thereon to vary the effective surface area of the distribution roller assembly and, therefore, the amount of moisture carried by the composite roller assembly. As illustrated, the assembly has a central roller portion with stub shafts projecting axially outwardly from opposite ends therof, with the roller sections positionable on the stub shafts. Therefore, the central roller portion can be dimensioned axially to be substantially equal to the narrowest paper intended to be used in the machine.

18 Claims, 2 Drawing Sheets

SEGMENTED MOISTURE FOUNTAIN ROLLER ASSEMBLY FOR PRINTING OR DUPLICATING MACHINES

FIELD OF THE INVENTION

This invention generally relates to printing or duplicating machines and, more particularly, to a segmented or sectioned distribution roller for a moisture system in a printing or duplicating machine to vary the effective surface area of the distribution roller.

BACKGROUND OF THE INVENTION

Printing machines normally include a printing couple which comprises a number of cylinders and/or rollers such as impression cylinders, master cylinders, blanket cylinders, form rollers, ductor rollers, transfer rollers, regulator rollers, oscillating rollers, and the like. An ink fountain is disposed generally at the rear of the machine for feeding ink to the various rollers of the printing couple which transfers images to copy sheets. In such printing machines as rotary offset lithographic duplicating machines, a moisture fountain also is disposed adjacent the printing couple for feeding moisture to the printing couple. A number of rollers which generally can be termed "distribution" rollers are provided between the ink fountain and/or moisture fountain for distributing ink and/or moisture to the printing couple of the machine.

One of the problems with moisture feeding systems in machines of the character described is the inability to effectively control and/or vary the amount of moisture fed to the printing couple for different or varying printing jobs, such as when different sizes of copy sheets are printed by the machine. When an excessive amount of moisture is fed through the system, the moisture tends to feed back or migrate through the rollers back to the ink fountain and contaminate the ink feeding system. If too little moisture is fed through the system, of course the printing quality will suffer.

Heretofore, the most common expedient for controlling the amount of moisture flow has been to use wipers which usually are located at opposite ends of a distribution roller for wiping or scraping moisture from the surface of the roller. The wipers are very difficult to control and are available in different sizes only in the most elaborate machines. Once a given size wiper is used in a machine, it either is in an "on" mode or an "off" mode and, consequently, there is no easy way to adjust the moisture feed in between the extreme modes. Even when the wipers are in their "on" or operative mode, such varying conditions as atmospheric humidity can greatly affect the moisture flow and, consequently, the copy quality.

This invention is directed to solving the above problems and satisfying a need for a new and improved distribution roller for a moisture system in a printing or duplicating machine wherein the effective surface area of the distribution roller easily can be changed or varied.

SUMMARY OF THE INVENTION

An object, therefore, of the invention is to provide a novel moisture distribution roller assembly for use in a moisture feeding system of a printing, duplicating or like machine.

In the exemplary embodiment of the invention, generally, the distribution roller assembly includes shaft means with a plurality of roller sections selectively positionable on the shaft means at varying positions axially thereof. Therefore, the number of roller sections and the spacing of the sections can be selected to vary the effective surface area of the distribution roller and, thereby, the amount of moisture carried by the composite roller.

Means are provided for locking the roller sections at any selected positions on the shaft means, and means also are provided for preventing relative rotation between the roller sections and the shaft means.

As disclosed herein, the shaft means is provided with a longitudinal keyway in the peripheral surface thereof. The roller sections are provided with set screws which can be threaded into the keyway both to lock the respective sections against longitudinal movement of the shaft means as well as to prevent rotation relative to the shaft means.

Preferably, the shaft means is formed by a pair of stub shafts projecting axially outwardly from opposite ends of a central roller portion of the distribution roller. The adjustable or variable roller sections thereby are disposed primarily at the ends of the distribution roller. Therefore, the axial length of the central roller portion can be selected to be substantially equal to the narrowest paper intended to be used in the machine.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
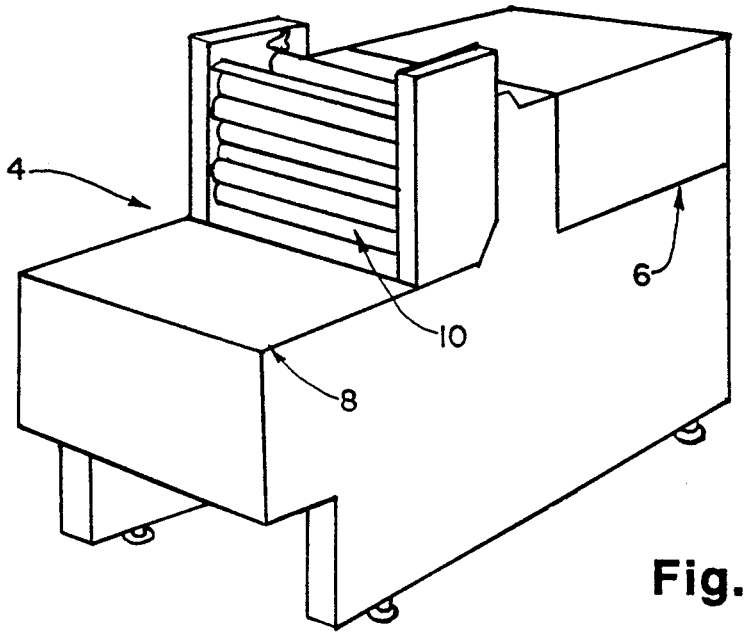
FIG. 1 is a somewhat schematic perspective view of a printing or duplicating machine in which the invention is applicable.

Referring to the drawings in greater detail, and first to FIG. 1, the invention is illustrated herein for use in a printing, duplicating or like machine, generally designated 4, which includes a sheet feeding end, generally designated 6, and an imaged copy exiting end, generally designated 8. The copy sheets which have images produced on one or both sides are stacked at exiting end 8 as is conventional with most printing or duplicating machines. The machine includes at least one printing couple, generally designated 10, which includes the conventional impression cylinders, blanket cylinders and master or plate cylinders. Usually, the printing couple includes one impression cylinder, one blanket cylinder and one master or plate cylinder Printing or duplicating machine 4 may be such as a rotary offset lithographic machine which includes an ink fountain for feeding ink to various distribution rollers of the printing couple which transfers images to copy sheets. In addition, a moisture fountain is disposed adjacent the printing couple for feeding moisture to the printing couple through a path defined by the distribution rollers.

Figure 2:
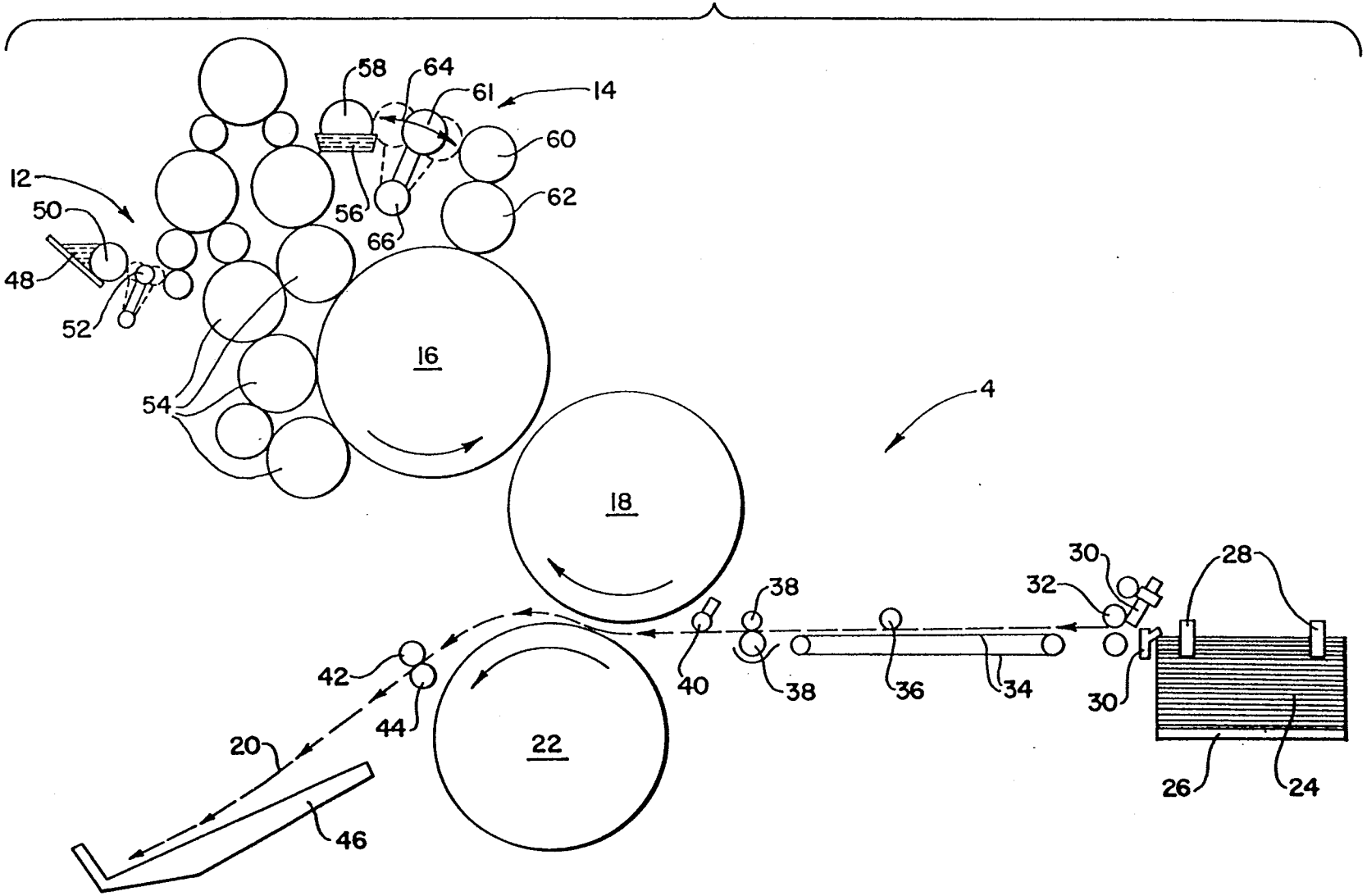
FIG. 2 is a schematic illustration of the major components of a machine in which the invention is applicable.

More particularly, the major components of the machine are shown schematically in generally applicable functional positions in FIG. 2. The machine depicted is an offset lithographic duplicating machine 4 which includes an ink system, generally designated 12, and a moisture system, generally designated 14, for feeding ink and moisture, respectively, to a master cylinder 16 to which a master is clamped. An image from the master is transferred to a blanket cylinder 18, through surface transfer. The blanket cylinder transfers the image to a copy sheet which follows a paper path through the machine as indicated by dotted-arrow line 20 which passes between blanket cylinder 18 and an impression cylinder 22.

Generally, paper sheets are stacked, as at 24, in a paper elevator 26. Air blowers 28, vacuum feet 30 and pull-out wheels 32 feed the sheets seriatum to a sheet transport conveyor 34 above which are mounted skid wheels 36. From conveyor 34, the sheets are fed seriatum by feed rollers 38 beneath a paper guide assembly 40 and between blanket cylinder 18 and impression cylinder 22, as described above. After images are transferred to the copy sheets, a paper ejector wheel 42 and a paper ejector roller 44 feed the sheets to a discharge station, generally designated 46.

Ink system 12 will be described generally and briefly, and includes an ink fountain 48 having a fountain roller 50. A ductor roller 52 feeds the ink from fountain roller 50 to a number of transfer rollers, regulator rollers, oscillating rollers and, ultimately, to three ink form rollers 54 which transfer the ink to a master on master cylinder 16 by surface contact.

Moisture system 14 includes a moisture fountain trough 56 and a fountain roller 58. Moisture is transferred from fountain roller 58 to a distribution roller 60 by a ductor roller 61 which reciprocates back and forth in the direction of double-headed arrow 64, about pivot 66, between fountain roller 58 and distribution roller 60. The construction and operation of the ductor roller is well known in the art. Moisture then is transferred, through continuous surface contact from distribution roller 60 to a form roller 62 which, in turn, transfers the moisture to the master on master cylinder 16, again through surface contact.

Figure 3:
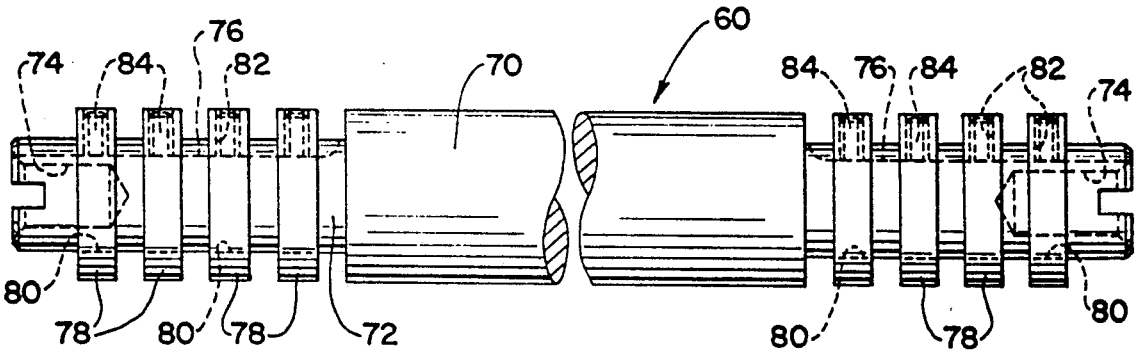
FIG. 3 is a broken elevational view of a moisture distribution roller incorporating the concepts of the invention.

FIG. 3 shows moisture distribution roller 60 to be an assembly incorporating the concepts of the invention. Of course, it must be understood that the invention is equally applicable for distribution rollers located either physically or functionally other than as is precisely shown in the particular machine described in relation to FIG. 2.

Specifically, FIG. 3 shows that distribution roller 60 includes a central roller portion 70 formed integral with a pair of stub shafts 72 projecting axially outwardly from opposite ends of the central roller portion. The distal ends of the stub shafts have sockets 74 for receiving appropriate bearing or driving means which appropriately rotatably mount the roller between appropriate side frame plates of the machine. Each stub shaft 72 also has groove means in the form of a "keyway" 76 cut into the outer peripheral surface of the stub shaft and extending longitudinally or in the axial direction thereof.

The invention contemplates providing a plurality of roller segments or sections 78 which are substantially ring-shaped and having central bores 80 for sliding the roller sections onto stub shafts 72. Therefore, each roller section 78 can be selectively positionable at varying positions axially of the stub shafts.

The outer cylindrical surfaces of roller sections 78 are of diameters substantially equal to that of central roller portion 70. Therefore, it can be understood that the effective surface area of the composite roller is defined by the total surface areas of central roller portion 70 and the particular number of roller sections 78 employed for a particular job, this surface area being selectively variable by the number and spacing of the roller sections. Consequently, the total amount of moisture carried by the composite roller is variable.

Means are provided for locking roller sections 78 to stub shafts 72 at any selected axial position thereon, and means are provided for preventing relative rotation between the roller sections and the stub shafts. More particular, each roller section 78 has a threaded bore 82 radially therethrough for threadingly receiving a set screw 84. Therefore, by aligning the set screws with keyways 76 in the stub shafts, the singular set screws on the respective roller sections perform the dual function of locking the roller sections axially relative to the stub shafts as well as preventing relative rotation between the roller sections and the stub shafts as the set screws are threaded into and abut against the bottom of the respective keyway 76. Preferably, the width of each keyway is slightly larger than the diameter of the set screws.

With the structure of distribution roller 60 described above in relation to FIG. 3, it can be seen that roller sections 78 carry moisture in the moisture feeding system but not as much as if the distribution roller was a completely solid roller from end-to-end, i.e., if central roller portion 70 spanned the entire length of the roller dimensions as is conventional. The roller sections are shown in FIG. 3 as being disposed on stub shafts only at the ends of the distribution roller. Theoretically, the entire roller could be fabricated of such roller sections. However, this might be an expensive expedient for some print shop machines. Consequently, as a practical matter, most machines have limiting parameters as to the narrowest copy paper or sheets which can be fed through the machine. The axial length of central roller portion 70, therefore, can be determined or selected to be substantially equal to the narrowest paper intended to be used in the machine.

In manufacture, a cost effective roller can be made simply by turning the roller on a lathe, outside the predetermined axial dimension of central roller portion 70, to form stub shafts 72 onto which roller sections 78 are positionable. With this scheme, central roller portion 70 would carry moisture under all conditions and all printing jobs. When different printing jobs are to be performed, particularly when wider paper or copy sheets are to be used in the machine, an operator simply adds the number of roller sections 78 necessary to provide good copy quality and prevent moisture feedback, as described above. In addition, in very humid atmospheric conditions, an operator can adjust the moisture flow simply by removing one or more of the roller sections. In essence, by providing an operator with a sufficient number of roller sections, he can vary the effective surface area of the distribution roller all the way from its narrowest axial dimension defined by central roller portion 70 to a full roller width whereby the roller sections would completely fill in the axial length of stub shafts 72. This gives the operator considerable flexibility and an ability to adjust the distribution roller in a very easy manner not heretofore available.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a printing, duplicating or like machine which includes a moisture system having a plurality of rollers for distributing moisture to a printing couple of the machine, a moisture distribution roller assembly comprising:

shaft means;

a central roller portion on the shaft means and being of an axial length selected to be substantially equal to the width of paper to be used in the machine;

a plurality of roller sections selectively positionable on the shaft means at opposite ends of the central roller portion to vary the effective surface area of the distribution roller assembly and, therefore, the amount of moisture carried thereby, the axial width of each roller section being substantially less than the axial length of the central roller portion.

2. The moisture distribution roller assembly of claim 1, including means for locking said roller sections at any selected positions on the shaft means.

3. The moisture distribution roller assembly of claim 2 wherein said locking means comprise set screws threaded through the roller sections for locking against the shaft means.

4. The moisture distribution roller assembly of claim 3 wherein said shaft means include groove means in the periphery thereof for receiving the set screws to positively prevent relative rotation between the roller sections and the shaft means.

5. The moisture distribution roller assembly of claim 1, including means for preventing relative rotation between the roller sections and the shaft means.

6. The moisture distribution roller assembly of claim 5 wherein said means for preventing relative rotation includes a keyway longitudinally of the shaft means and means on the roller sections projecting into the keyway.

7. The moisture distribution roller assembly of claim 1 wherein said shaft means comprises a pair of stub shafts projecting axially outwardly from opposite ends of said central roller portion.

8. The moisture distribution roller assembly of claim 7 wherein said central roller portion has an axial length selected to be substantially equal to the narrowest paper intended to be used in the machine.

9. The moisture distribution roller assembly of claim 7 wherein said central roller portion is unitary with the shaft means.

10. In a printing, duplicating or like machine which includes a moisture system having a plurality of rollers for distributing moisture to a printing couple of the machine, a moisture distribution roller assembly comprising:

a central roller portion of an axial length selected to be substantially equal to the width of paper to be used in the machine;

a stub shaft projecting axially outwardly from each opposite end of the central roller portions;

a plurality of roller sections selectively positionable on either one of the stub shafts at varying positions axially thereof to vary the effective surface area of the distribution roller assembly and, therefore, the amount of moisture carried thereby, the axial width of each roller section being substantially less than the axial length of the central roller portion;

means for locking the roller sections at selected positions on the stub shafts; and means for preventing relative rotation between the roller sections and the stub shafts.

11. The moisture distribution roller assembly of claim 10 wherein said locking means comprise set screws threaded through the roller section for locking against the stub shafts.

12. The moisture distribution roller assembly of claim 11 wherein said stub shafts each include a keyway in the periphery thereof for receiving the set screws to prevent relative rotation between the roller sections and the stub shafts.

13. The moisture distribution roller assembly of claim 10 wherein said means for preventing relative rotation includes a keyway longitudinally of the stub shafts and means on the roller sections projecting into the keyway.

14. The moisture distribution roller assembly of claim 10 wherein said central rolled portion has an axial length selected to be substantially equal to the narrowest paper intended to be used in the machine.

15. The moisture distribution roller assembly of claim 10 wherein said central roller portion is unitary with the stub shafts.

16. In a printing, duplicating or like machine which includes a moisture system having a plurality of rollers for distribution moisture to a printing couple of the machine, a moisture distribution roller assembly comprising:

shaft means;

a central roller portion on the shaft means and being of an axial length selected to be substantially equal to the width of paper to be used in the machine;

a plurality of roller sections slidably mounted on the shaft means at opposite ends of the central roller portion to vary the effective surface area of the distribution roller assembly and, therefore, the amount of moisture carrier thereby, the axial width of each roller section being substantially less than the axial length of the central roller portion;

means for locking said roller sections at any selected portions on the shaft means; and means for preventing relative rotation between the roller sections and the shaft means.

17. The moisture distribution roller assembly of claim 16 wherein said locking means comprise set screws threaded through the roller sections for locking against the shaft means.

18. The moisture distribution roller assembly of claim 17 wherein said shaft means include a keyway in the periphery thereof for receiving the set screws to prevent relative rotation between the roller sections and the shaft means, the set screws being of a length to engage the bottom of the keyway to provide said means for locking the roller sections at any selected positions on the shaft means.

* * * * *